United States Patent [19]

Hinago

[11] 3,979,990

[45] Sept. 14, 1976

[54] KEYBOARD ARRANGEMENT IN ELECTRONIC MUSICAL INSTRUMENT

[75] Inventor: Yasuhiro Hinago, Hamamatsu, Japan

[73] Assignee: Nippon Gakki Seizo Kabushiki Kaisha, Hamamatsu, Japan

[22] Filed: May 27, 1975

[21] Appl. No.: 580,758

[30] Foreign Application Priority Data

May 28, 1974 Japan ..... 49-61170[U]
May 28, 1974 Japan ..... 49-61171[U]

[52] U.S. Cl. ..... 84/1.24; 84/1.1; 84/423; 84/DIG. 7

[51] Int. Cl.[2] ..... G10H 1/02

[58] Field of Search ..... 84/1.09, 1.1, 1.24–1.27, 84/423, 433, DIG. 7

[56] References Cited

UNITED STATES PATENTS

| | | | |
|---|---|---|---|
| 3,580,979 | 5/1971 | Amano | 84/DIG. 7 X |
| 3,634,593 | 1/1972 | Nagano | 84/1.24 X |
| 3,652,774 | 3/1972 | Ohno | 84/1.24 |
| 3,715,447 | 2/1973 | Ohno | 84/1.24 |
| 3,835,235 | 9/1974 | Amano | 84/1.24 X |
| 3,845,683 | 11/1974 | Lehmann | 84/433 X |

*Primary Examiner*—John Gonzales
*Attorney, Agent, or Firm*—Cushman, Darby & Cushman

[57] ABSTRACT

A keyboard arrangement in electronic musical instrument comprising playing keys movable to cover a predetermined distance in normal play and also being able to move farther in excess of said distance in accordance with the pressure applied to the keys, a movable arm arranged at position corresponding to each key at its depressed position, and a sensor means provided for said arm to detect the amount of the excessive distance covered by the movable arm and the speed thereof to generate a signal to be used for the control of expression such as tone volume, tone color and the like.

The keyboard arrangement preferably further includes a deformable cushion means normally nondeformingly contacting, at its upper end, the bottom surface of the movable arm member during the normal movement of the positionally corresponding key but is deformed when the key makes a movement in excess of the normal distance to be covered by the key. Thus, the arm is inhibited to develop undesirable vibrations during its movements and precise detection of the amount of its movement can be made.

9 Claims, 11 Drawing Figures

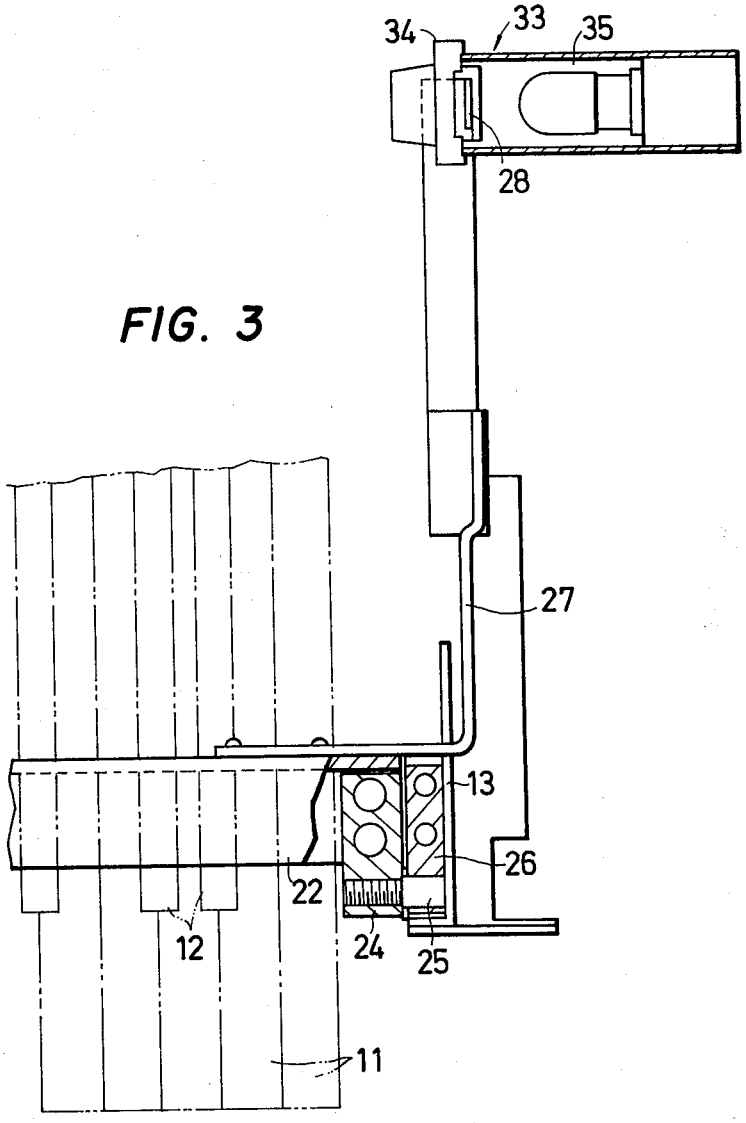
FIG. 3
FIG. 4
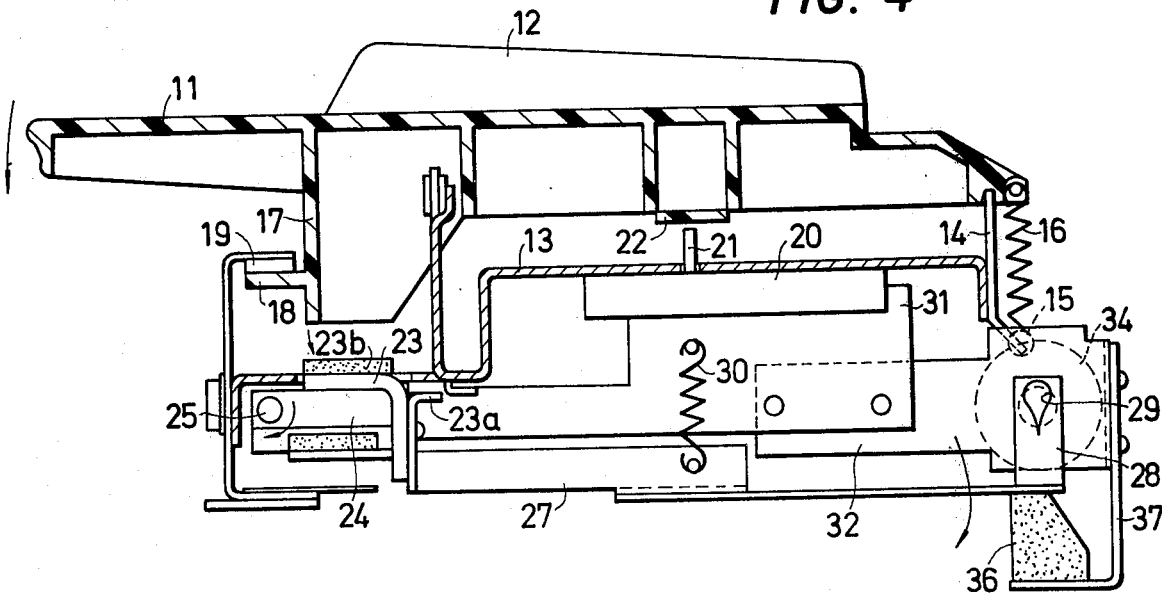

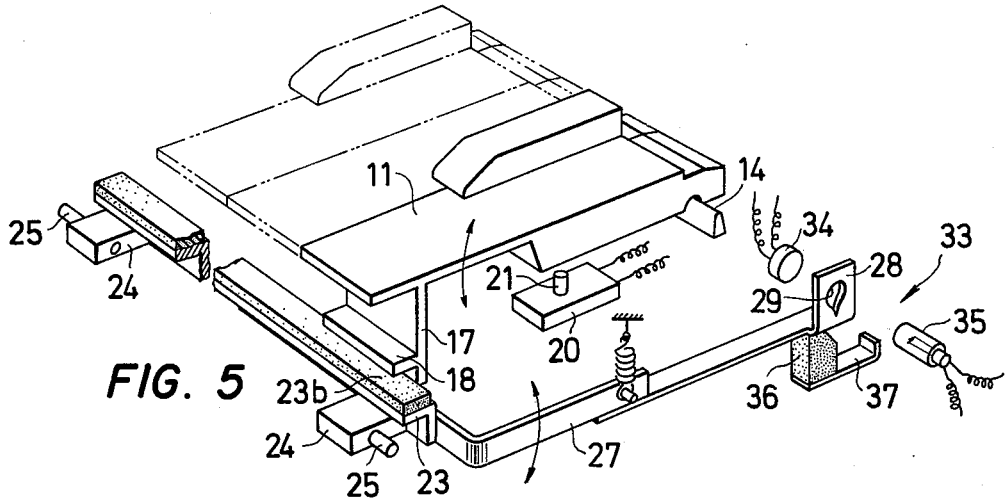
FIG. 5
FIG. 9
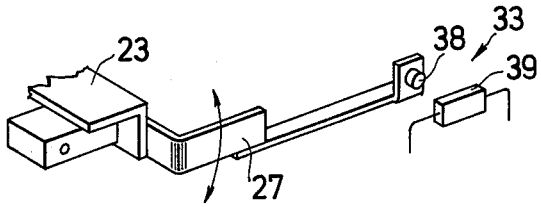
FIG. 10
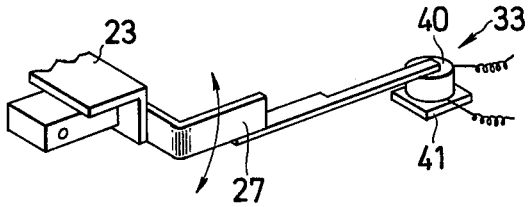
FIG. 11
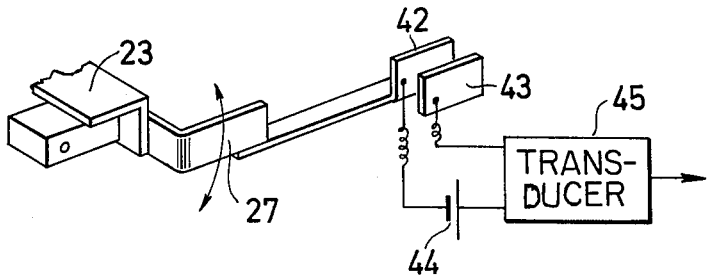

KEYBOARD ARRANGEMENT IN ELECTRONIC MUSICAL INSTRUMENT

BACKGROUND OF THE INVENTION

1. Field Of The Invention:

The present invention pertains to an improvement in the keyboard arrangement of electronic musical instrument designed to generate desired expression sounds by a mere depression of keys.

2. Description Of The Prior Art:

Control of expression sounds or the so called "after-control" which is performed by the operation of keys of the keyboard of an electronic musical instrument is intended to impart variations of sound volume, tone color and tone pitch to the musical sounds generated from the tone source, in accordance with the magnitude of the depression force and speed of any desired key or keys, to thereby add subtle expression effects to the musical sounds, in accordance with the intension of the player himself or with the prescribed musical scores.

In a musical instrument such as a piano using strings, it is possible to produce delicate variations of sounds by varying the depression force and speed of a key. In an electronic musical instrument, however, only a predetermined simple sound corresponding to a certain note of a certain tone interval is produced by, for example, a low frequency oscillator circuit. With only such simple musical sounds, however it is impossible to perform a playing of delicate music, and the sounds produced would be only monotonous that would cause no musical sentiment to the listeners.

In order to overcome this drawback of the electronic musical instrument, there has been proposed to attach an independent expression generating means to each key of the electronic musical instrument to enable a desired expression or after-control effect to be added to the normal musical sounds. In the electronic musical instrument of the prior art, the addition of such an expression, i.e. after-control effect of tone color, tone volume and, for example, vibrato effect, to the basic musical sounds was carried out by independent control devices assigned exclusively for these purposes, and these devices were provided independently of the keyboard arrangement of the instrument. Therefore, the overall structure of the electronic musical instrument tended to become quite complicated and accordingly expensive. Besides, those who play a piano but have no experience in playing an electronic musical instrument will find this instrument quite difficult to operate. Therefore, there has been a demand for an electronic musical instrument which can produce various controlled effects in a much simpler manner without requiring such additional independent control devices.

In order to meet such a demand, there has been proposed an improved keyboard arrangement having a plurality of key-associated sensors each comprising a conductive elastic member capable of being compressed in accordance with a vertical and/or horizontal key movement to vary the impedance of the conductive member and to give off a control signal corresponding to the degree of such movement of the key. An electrical signal derived from the impedance variation of the conductive elastic member by the selective depression of keys is employed as an after-control signal.

An example of such known arrangement comprises a lengthy ribbon of conductive rubber-like member extending in the direction of the row of keys of the keyboard and beneath the row of keys. A depression of a key will compress and deform the conductive rubber-like member so that the electric resistance in said conductive member is varied, and such variation of resistance is derived as a control signal of the tone which is generated at the tone generator circuit.

In such arrangement, however, the material of the detecting member with which the speed and the amount of the key depression are detected is rubber or like elastic material. Accordingly, it is difficult to expect an identical property throughout the entire portions of such elastic material even when keys are depressed with an identical force or speed. Thus, there is the drawback that the generated sounds could have unintended different expressions for the respective keys. However, an effort to eliminate this drawback by seeking a conductive elastic material having an identical quality throughout thereof will be practically in vain and would lead to a high cost.

SUMMARY OF THE INVENTION

It, is, therefore, a primary object of the present invention to eliminate the aforesaid drawbacks of the key-arrangement designed to accomplish touch-control of musical sounds by the depression of the keys, and to provide an improved key-arrangement which can produce any desired after-control effect of sounds of a simple structure by a mere depression of the keys.

Another object of the present invention is to provide a key arrangement of the type described, which can detect precisely and accurately any amount of variation in the force and speed of depression of keys and which, accordingly, can follow and give out the subtle nuance of expression intended by the player.

Still another object of the present invention is to provide a key arrangement of the type described, which has a pivotable arm positioned beneath the row of keys to correspond to each key and which has a sensing means associated with said arm so that the amount and speed of movement of the key being depressed are amplified by this arm and the amplified amount of movement is detected by this sensing means to be generated therefrom as a control signal for a given sound generated from the tone source.

Yet another object of the present invention is to provide a key arrangement of the type described, which has a vertically movable arm arranged beneath each key and associated with a sensing means to sense the variation of the movement of the arm and to generate a control signal in accordance with this variation.

A further object of the present invention is to provide a key arrangement of the type described, which has a deformable elastic member normally contacting the bottom surface of the key-associated movable arm so that this arm is inhibited to make any undesirable vibrations due to the impact from the depression of keys, thereby enabling the detection of the movement of the keys to be made accurately.

BRIEF DESCRIPTION OF THE DRAWINGS

FIG. 3 is a plan view showing a general arrangement of the keyboard and its associated detecting means.

FIG. 4 is a side elevation, partly in section, similar to FIG. 2, but showing another aspect of the present invention.

FIG. 5 is an explanatory perspective view of the keyboard arrangement shown in FIG. 4, with parts broken away.

FIGS. 9, 10 and 11 are modifications of detecting mechanism applicable to the present invention.

Like parts are indicated by like reference numerals for the simplicity of explanation.

DETAILED DESCRIPTION OF THE PREFERRED EMBODIMENTS

Figure 1:
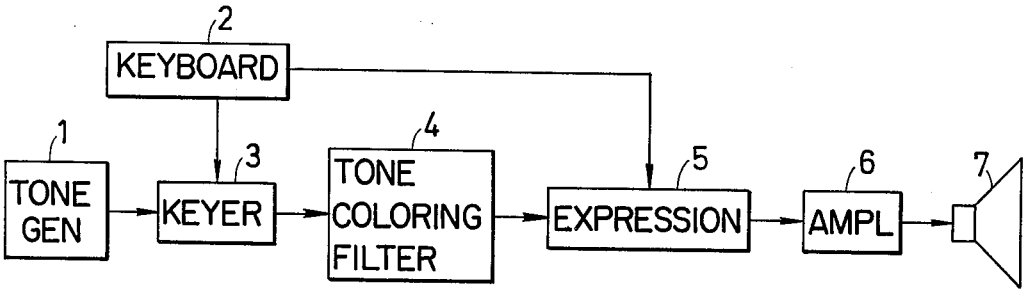
FIG. 1 is a block diagram of a general arrangement of an electronic musical instrument equipped with a keyboard arrangement embodying the present invention.

FIG. 1 shows a block diagram of an example of an electronic musical instrument embodying the present invention. The electronic musical instrument comprises a tone generator circuit 1, a keyboard 2, a keyer circuit 3, a tone coloring filter circuit 4, an expression circuit 5, an amplifier circuit 6, and a loud-speaker 7, all of which are known parts in the art. However, according to the present invention, the manipulation of the keyboard 2 enables not only the keyer circuit 3 to be operated but also the expression circuit 5 such as volume control circuit to be controlled very easily and effectively.

Figure 2:
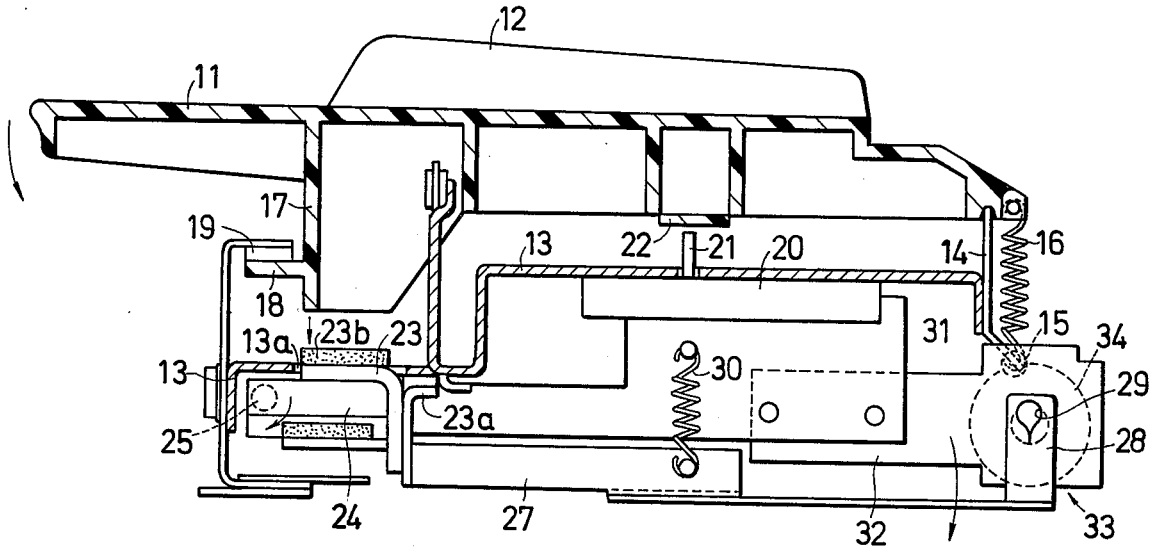
FIG. 2 is a side elevation, partly in section, of the keyboard arrangement embodying the principal aspect of the present invention.

Let us now explain in detail referring to FIG. 2 which is a side elevation of a keyboard arrangement, partly in section, showing an example of the present invention. In FIG. 2, reference numeral 11 represents a white (natural) key and 12 represents a black (sharp and flat) key. These keys 11 and 12 are elongated from the forward to the rearward and are arranged horizontally in a row in a required number, respectively, on a key-supporting frame 13.

Description will hereunder be made with respect to only the white key for the simplicity of explanation. Each key 11 is pivotally supported at its bottom surface near the rear end thereof by an upright supporting member 14 so that the key 11 is capable of making pivotal movement about the upper end of the upright supporting member 14 which serves as a fulcrum. This supporting member 14 has a bent portion 15 formed at its lower end. A coiled spring 16 is applied between the rear end of the key 11 and the bent portion 15 of the upright supporting member 14 to normally urge the forward end of the key 11 upwardly. A pressing member 17 depends downwardly from the bottom surface of each key 11 integrally therewith at a position closer to the forward end of the key. A movable stopper 18 is formed integrally with the pressing member 17 to extend from one surface of this pressing member to the foreground thereof. This movable stopper 18 is capable of being brought into contact with a fixed stopper 19 which is provided on the key-supporting frame 13, to thereby limit the uppermost position of the key 11, i.e. the position of the key when it is not depressed.

A key-switch 20 is attached to the bottom surface of the key-supporting frame 13 so as to correspond in position to each key 11. An actuator 21 for the key-switch 20 extends upwardly through the key-supporting frame 13 to face a contacting member 22 which is provided on the bottom surface of each key 11. As will be noted from FIG. 2, this contacting member is spaced at a small distance from the top of the actuator 21 whenever the key 11 is not depressed. By depressing the key, the contacting member 22 is brought into contact with the actuator 21 so that the circuit of the key-switch 20 is closed. Thus, a tone signal corresponding to the note of this key 11 is derived from the tone generator circuit 1 and a musical sound of a required note is produced therefrom.

A lengthy movable member 23 having an L-shaped cross section is provided at a distance from the key 11 to extend horizontally along the direction of the row of keys 11 and to face, at a certain spaced distance, each of the pressing members 17, as will be noted from FIGS. 2 and 3. The elongate movable member 23 has at its both ends blocks 24 (one of which is shown in FIG. 3) which are secured fixedly to the member 23. From each of the blocks 24 is extended a supporting shaft 25 which is rotatably supported by a bearing fitting 26 secured to the forward part of the key-supporting frame 13. Thus, the member 23 is pivotable about the shaft 25. The upper part of the member 23 is normally situated in the cutout 13*a* formed in the frame 13 at a position right below the pressing member 17, so that the member 23 can be depressed by the downward movement of the key 11. A projection 23*a* having a felt strip thereon is extended rearwardly from the member 23 and is engageable with the lower surface of the frame 13 to define the uppermost limit of the movable member 23. Further, a ribbon of felt 23*b* is secured to the top surface of the movable member 23 to absorb the impact which will be developed when the pressing member 17 is brought into pressure-contact with the movable member 23. To one end of the movable member 23 is attached, integrally therewith, a movement amplifying arm 27 which extends rearwardly (in FIG. 2, to the right side). From the rear end portion of this movement amplifying arm 27 extends upwardly a thin shutter plate 28. This shutter plate 28 is arranged to be parallel with the rotational planes of the block 26 and the movement amplifying arm 27. This shutter plate 28 has a tear-drop shaped aperture 29 formed centrally thereof. To the central portion of the movement amplifying arm 27 is applied one end of a spring 30 having its other end anchored to a supporting plate 31 which, in turn, is secured to the key supporting frame 13, to normally urge the movement amplifying arm 27 upwardly or toward the key 11. A sensor attachment plate 32 is secured to said supporting plate 31 in such a way as to extend beyond the rearward end of the movement amplifying arm 27 and in parallel with the shutter plate 28. A detecting means generally indicated at 33 is secured to the sensor attachment plate 32. This detecting means 33 is comprised of a photoelectric element 34 such as CdS and a light source 35 such as a lamp. The shutter plate 28 is arranged so that it can be brought into and out of the space between the light source 35 and the photoelectric element 34. This shutter plate 28 regulates the amount of light incident on the element 34 in accordance with the movement of the arm 27. Accordingly, the variation of the resistance obtained from the photoelectric element can be used to provide expression such as volume control to the musical sound.

Figure 6:
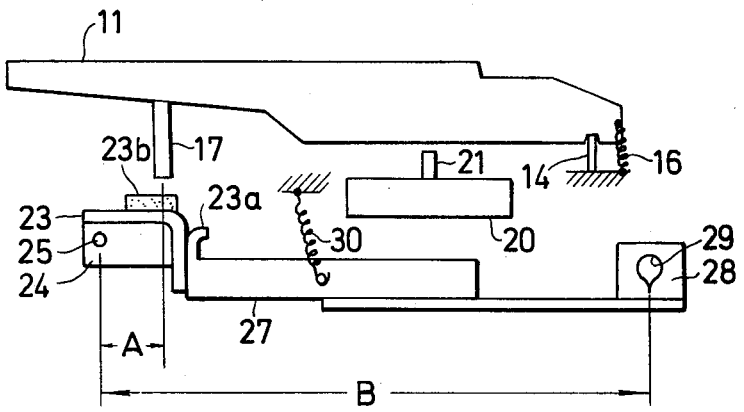
FIGS. 6, 7 and 8 are explanatory side elevations showing the sequential movements of key depression and of the key-associated detecting mechanism.

Next, the operation of this example will be described hereunder. When a key 11 which is in its non-depressed position shown in FIG. 6 is lightly depressed, this key will make a downward swinging movement about the top of the supporting member 14 serving as a fulcrum.

Figure 7:
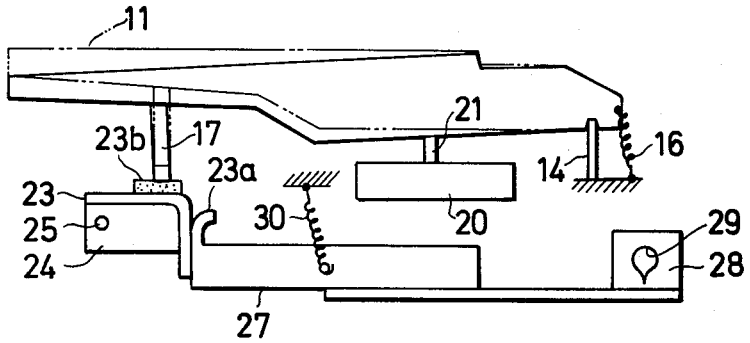

This downward movement of the key 11 during the depression, however, is limited by the top of the movable member 23 which remains in its initial position due to the force of the spring 30, as shown in FIG. 7. This position of the key is its normal lowermost position for its normal light depression. Whereas, due to the downward movement of the key 11, the actuator 21 is brought into contact with the contacting member 22 and is moved downwardly to close the key-switch 20. Thus, a tone signal corresponding to the note of the depressed key 11 is generated from the tone generator circuit 1. This tone signal is amplified by the amplifier circuit 6 and is given out as an audible sound through the speaker 7.

Figure 8:
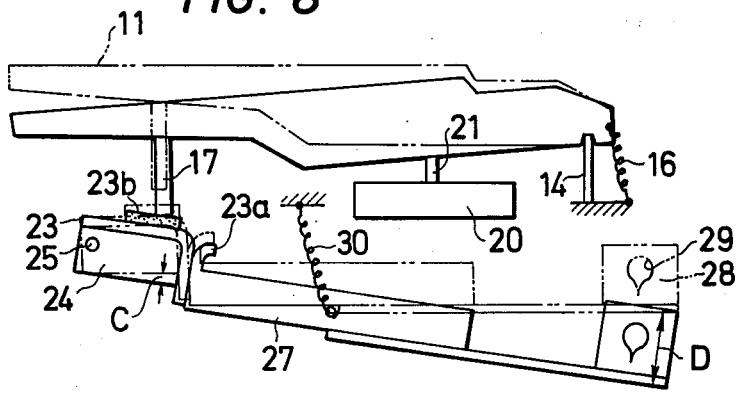

When the key 11 is depressed downwardly further with a stronger force from its above-mentioned normal lowermost position, its pressing member 17 will press downwardly the movable member 23 and accordingly its associated block 26 to swing downwardly clockwise in FIG. 2 about the supporting shaft 25. Whereupon, the movement amplifying arm 27 will be caused to pivot downwardly in proportion to the angle of the pivotal movement of the movable member 23 against the force of the spring 30, as shown in FIG. 8. As a result of the pivotal movement of the amplifying arm 27, the shutter plate 28 is moved so that the larger area of the tear-drop shaped aperture 29 will be progressively placed into the path of light from the light source 35, between this light source and the photoelectric element 34. Accordingly, the element 34 will receive an increasing amount of light from the light source 35.

According to this example, the pressing member 17 is arranged to depress the movement amplifying arm at a position closer to the supporting shaft 25. Therefore, the amount of movement of the key 11 is amplified by the rear end of the amplifying arm 27. Thus, the amount of the movement of the key 11 can be detected accurately. Explaining in more detail with reference to FIGS. 6 and 8, the distance A between the pivoted point 25 of the movable member 27 and the point where the pressing member 17 depresses the movable member 23 is far shorter than the distance B between the pivoted point 25 of the movable member 27 and a point where the shutter plate 28 is provided. Accordingly, it is possible that the movement C at the depressing point of the pressing member 17 is manifested far greater at the point where the shutter plate is provided, being expressed as the movement D.

As discussed above, the musical sound produced from the electronic musical instrument can be delicately varied to make a desired expression. Since the movement amplifying arm 27 is of a considerably great length covering the length of each key 11, the impact received by the movable member 23 from the pressing member 17 tends to be manifested as a vibration of the movable member 23. In order to avoid this inconvenience, according to another aspect of the present invention, there is provided a cushion member 36 attached to a cushion member supporting fitting 37 which is integral with the sensor attachment plate 32 as shown in FIG. 4. The bottom surface of the movement amplifying arm 27 normally is in contact with the top of the cushion member 36. Accordingly, any impact of the members 23 and 27 is absorbed by this cushion member 36. Thus, the shutter plate 28 can make a smooth movement exactly corresponding to the amount and angle of rotation covered by the movable member 23 without causing any vibration. Therefore, the accurate amount of movement of the key 11 can be detected, even for a quick and strong depression of the key 11, without causing any undesirable ill effect on the detecting means.

In this latter aspect of the present invention using the cushion member 36, the latter member 36 is made with an elastic spongy material. It should be understood, however, that a weak spring may be used in place of the spongy material so long as this spring is able to absorb the vibrations. However, a material such as sponge having an elasticity, recoverability and deformability is preferred.

Description has been made on examples wherein the movement amplifying arm 27 having its one end pivotably supported on a shaft 25 is employed to actuate the detecting means 33. It should be understood, however, the arrangement may be provided so that the amplifying arm 27 as a whole is allowed to move vertically and not pivotally by the depression of the key 11. In such an instance, the movable member 23 is arranged so that it is pulled upwardly by a pair of springs as will be understood by those skilled in the art.

Next, description will be made on some other examples of the detecting means 33. Referring now to FIG. 9, the movement amplifying arm 27 is provided, at its rearward end, with a magnet 38 in place of the shutter plate 28 at a position corresponding to the position of the shutter plate 28. Also, at the position of the photoelectric element 34, there is provided a fixed magneto-sensitive element 39. As the movement amplifying arm 27 is rotated, the magnet 38 will shift its position accordingly. In accordance with the changes in magnetism at the varying positions assumed by the magnet 38 the amount of current which flows through the magneto-sensitive element 39 varies and an electric signal for controlling the expression of the musical sound is derived.

Still another modification of the detecting means will be described by referring to FIG. 10. In this example, the rear end of the movement amplifying arm 27 is formed to have a horizontal flat surface. A piezo-electric element 40 capable of converting a pressure to an electric signal is fixed between said rearward end of the amplifying arm 27 and a base frame 41 of said key supporting frame 13 for developing an electric signal having a piezo effect in accordance with the changes in the depression speed and force. As described previously, when the amplifying arm 27 is rotated, there is generated from said piezo-electric element 40 a voltage corresponding to the amount of movement of the amplifying arm 27 and this voltage is applied to a desired control circuit to thereby accomplish the control of expression of musical sound.

A still further modification of the detecting means 33 is illustrated in FIG. 11. In this example, the amount of movement of the amplifying arm 27 is detected in terms of the electric static capacity. More specifically, a movable electrode 42 is secured to the rear end of the movement amplifying arm 27 in parallel therewith. A fixed electrode 43 is provided to face this movable electrode 42 at a distance therefrom to be insulated therefrom. These two electrodes 42 and 43 are connected to a power source 44 and a transducer 45 in series. By the rotation of the amplifying arm 27, the amount of abutment of the two electrodes 42 and 43 will vary, causing the capacitance to vary accordingly. This amount of change in the capacitance is converted by the transducer 45 as a variation in terms of voltage or current and is transmitted to a desired control circuit.

These modifications of the detecting means 33 can be equally effectively applied to the arrangement of the amplifying arm 27 which is arranged so that this arm as a whole is moved vertically and not pivotally.

Furthermore, those skilled in the art will understand that the movable member 23 and the movement amplifying arm 27 which have been described as single lengthy members, respectively, may be replaced as required by independent, plural number of such members and arms arranged one set of member 23 and arm 27 for each key. In such a case, the entire arrangement will become much complicated.

Also, description has been made on instances where a single sensor mechanism is provided for the whole keyboard arrangement. It should be understood, however, that any required number of such mechanism may be provided.

I claim:

1. A keyboard arrangement for an electronic musical instrument, comprising:

a plurality of elongated keys pivotably supported and arranged in juxtaposed relationship, each of said keys being movable at a predetermined distance, movable means for provisionally limiting the movement of the key intermediate of said distance when the key is depressed with a smaller depressing force, said movable means being depressable along with the key when the key is further depressed with a larger force, extension means extending along the elongated key, said extension means being secured to said movable means so as to be depressable therewith, detecting means for detecting movement of said extension means and producing a control signal in accordance therewith, the key being provided with a pressing member to effect the depression of said movable means, and said movable means for the key being pivoted near the pressing member so that the distance between the pivoted point of said movable means and the depressing point of said pressing member is shorter than the distance between the pivoted point of said movable means and a point where said detecting means is provided.

2. A keyboard arrangement according to claim 1, in which said movable means is a movable member common to said plurality of keys, said movable member extending transversely of said keys.

3. A keyboard arrangement according to claim 2, in which said extension means is a single extension member attached to said movable member.

4. A keyboard arrangement according to claim 1, in which said extension means is biased toward the key.

5. A keyboard arrangement according to claim 1, further comprising cushioning means made of elastic, deformable material and supportably in contact with said extension means for inhibiting undesired vibrations of said extension means due to impact from the depression of keys.

6. A keyboard arrangement for an electronic musical instrument comprising:

a plurality of elongated keys pivotably supported and arranged in juxtaposed relationship, each of said keys being vertically movable at a predetermined distance, a movable member common to said plurality of keys and extending transversely of said keys, said movable member being vertically movable through the vertical movement of each of said keys, an amplifying member secured at one end to said movable member and extending along the elongated key, and detecting means for detecting the movement of said amplifying member and producing a control signal in accordance therewith.

7. A keyboard arrangement according to claim 6, in which each of said keys is provided with a pressing member to effect the depression of said movable member, and said movable member is pivoted near the pressing member so that the distance between the pivoted point of said movable member and the depressing point of said pressing member is shorter than the distance between the pivoted point of said movable member and a point where said detecting means is provided.

8. A keyboard arrangement according to claim 7, in which said amplifying member is biased toward said key.

9. A keyboard arrangement according to claim 6, further comprising a cushioning member made of elastic, deformable material, mounting means mounting said cushioning member so that said amplifying member normally rests on said cushioning member whereby said cushioning member functions to absorb impact vibrations of said amplifying member.

* * * * *